US005582639A

United States Patent [19]

Hove

[11] Patent Number: 5,582,639

[45] Date of Patent: Dec. 10, 1996

[54] METHOD OF PREPARING AN EMULSION-OR-ASPHALT-CONCRETE FOR USE AS A ROAD MATERIAL

[76] Inventor: Leo Hove, Bystaeunevej 4, 5750 Ringe, Denmark

[21] Appl. No.: 602,573

[22] Filed: Feb. 14, 1996

Related U.S. Application Data

[63] Continuation of Ser. No. 232,164, Apr. 29, 1994, abandoned.

[30] Foreign Application Priority Data

Oct. 30, 1991 [DK] Denmark ..... 1793/91

[51] Int. Cl.$^6$ ..... C08L 95/00

[52] U.S. Cl. ..... 106/281.1; 106/280

[58] Field of Search ..... 106/280, 281.1

[56] References Cited

U.S. PATENT DOCUMENTS 4,579,458 4/1986 Ohlson ..... 366/8

4,832,497 5/1989 Wentzel ..... 366/9

4,978,393 12/1990 Maheas ..... 106/281.1

FOREIGN PATENT DOCUMENTS 491107 6/1992 European Pat. Off. .

334588 9/1930 United Kingdom .

*Primary Examiner*—Helene Klemanski

*Attorney, Agent, or Firm*—Antonelli, Terry, Stout & Kraus

[57] ABSTRACT

In the production of emulsion concrete to be laid out as a road material it is customary that the applied stone fractions are mixed together with a binder, which is a bitumen emulsion based on a relatively low viscid bitumen, as the material would otherwise be very difficult to shape by the laying operation. According to the invention, the coarse stone fraction is pretreated with a rapid breaking emulsion based on high viscid bitumen, and only thereafter the fine stone fraction with low viscid binder is added. Thereby it is possible to maintain a good shapeability of the material and yet obtain a significantly improved bonding of or in the laid out material. A method for the production of asphalt concrete is also disclosed.

10 Claims, No Drawings

METHOD OF PREPARING AN EMULSION-OR-ASPHALT-CONCRETE FOR USE AS A ROAD MATERIAL

This is a continuation of application Ser. No. 08/232,164, filed Apr. 29, 1994 now abandoned.

BACKGROUND OF THE INVENTION

The present invention relates to a method of preparing an emulsion- or asphalt-concrete for use as a road material.

It is-a-well known that asphalt concrete is laid out in a smoking hot condition, whereby it is possible to keep the mixture of stones and bitumen suitably shapable for an even laying-out and compression, just as the mixture may then have a large content of high viscid bitumen, thereby ensuring a good bonding and yet a certain, desired resiliency in the laid-out material, when its temperature decreases to ambient temperature. However it is very energy consuming to effect the associated heating of the material.

Against this background has been developed a 'cold' technique, which may well have certain drawbacks or limitations, but nevertheless is considered advantageous in that the heating can be avoided. The technique is based on the use of a bitumen emulsion in admixture with a graded stone material. An aqueous bitumen emulsion has no particular bonding ability of its own, but in time a so-called 'breaking' of the emulsion occurs, whereby the emulgated bitumen fractions float together and the water is segregated, such that the bitumen may thereafter act as a binding agent that can stick to the stone surfaces and bond these together. By means of different additives it is possible to control rather accurately when this breaking should take place after the mixing operation. It is achievable, therefore, that the mixture can be prepared and transported to the laying area and be laid-out therein prior to the breaking having proceeded to the point where the material will not thereafter be suitably easily shapeable.

If the emulsion is or has not broken almost as soon as it has been laid out, one problem among others will be that in case of rain after the laying out a more or less extensive washing out of the emulsion may take place, this of course being highly unlucky or in the worst case even fatal for the work.

It is well known, therefore, that the breaking should be adjusted so as to have proceeded widely already at the time of the laying out, even though this will create the problem that it is not possible to use any particularly hard binding bitumen in the emulsion. If the breaking of an emulsion with such a hard or high viscid bitumen has proceeded widely just before the laying out, it will be impossible to effect the laying work in an easy and orderly manner under 'cold' conditions, because the material will then be so strongly bonded together that it cannot be reasonably easily shapable.

It has become a common practice that for usual applications of emulsion concrete it is only possible to use emulsions based on a relatively low viscid bitumen having a viscosity of up to some 3000 $mm^2$/sec at 60° C. However, such materials will have a relatively poor stability, so the method is used only on roads with a low traffic load.

It could be possible to use a bitumen of a higher viscosity and even an increased amount of emulsion if care is taken that the emulsion breaks only partly during the mixing process or prior to the laying out, but this would also create serious problems. Depending on the grain curve of the stone material it may be impossible to secure an optimal bitumen percentage, because the stone material can only 'carry' a certain amount of unbroken emulsion without surplus emulsion flowing off. Such a flow off of incompletely broken emulsion will take place during the truck transport of the material from the mixing place to the working place and thus give rise to considerable smudging problems for other road-users. Moreover, after its laying out and compaction on the road, the material will exhibit cavities holding unbroken emulsion that will cause the finished road layer, during a long period of time, to be very sensitive to rain, which causes a washing out of bitumen.

It has earlier been recognized that with a minimized, yet sufficient total amount of emulsion the problem may occur that the emulsion is predominantly 'absorbed' by the finer stone fractions, such that a required total wrapping of the coarse stones will not be achieved unless still more emulsion is added. It has been proposed to remedy this by initially supplying to the mixing stage the coarse stone fraction and the amount of emulsion necessary for a total wrapping of these stones, while the finer stone fraction is added later on, if required together with more emulsion, see e.g. U.S. Ser. No. 923,891 and GB-C-334,588. It is possible to thereby avoid a direct waste of surplus emulsion, but there will be no resulting quality improvement of the laid out material.

DESCRIPTION OF THE INVENTION

It is the purpose of the invention to provide a method by which it will be practically possible to make use of an emulsion based on a noticeably harder bitumen, i.e. a bitumen of higher viscosity, such that the laid out road layer can exhibit a considerably increased strength and yet be suitably shapeable in connection with the laying-out, without thereafter being sensitive to any washing out of the bitumenous binding agent.

The invention is based on the consideration that the material as a whole will be supple and shapeable as long as the fine stone fraction has not been bonded by a high viscid bitumen, whether or not the stones in the coarse fraction have already been wrapped by a more or less broken emulsion based on a high viscid bitumen. This has lead to a further recognition of the fact that in an initial phase of the mixing process it will be possible to mix the coarse stone fraction with an emulsion based on high viscid bitumen and with an amount thereof satisfying the full wrapping need for the stones in this fraction, when this emulsion is adapted to break effectively already during the mixing process, while the finer stone fraction, also called the mortar, can be added thereafter, with further addition of emulsion, though now a different emulsion based on a low viscid bitumen, but still adapted to break no later than by the laying out of the material, that is prior to or shortly after the laying out and preferably even before the material leaves the mixing plant.

The finally admixed emulsion will make the entire mixture supple and formable, i.e. the mixture can be laid out evenly and with ordinary equipment, although the stones of the coarse fraction have already been coated with a layer of broken, hard bonding bitumen. Because both types of emulsion are adaptable to a total or extensive breaking already before the mixture leaves the mixing plant, problems with respect to flow off during transportation to the working area will be avoided, and the laid out layer will be insensitive to rain right from the beginning.

It has been found that after the laying out a migration between the 'hard' bitumen on the coarse stones and the 'soft' bitumen in the finer stone fraction will take place rather soon, such that the result will be a total bonding obtained quicker and with a more high viscid and therewith better binding bitumen than so far known or achievable.

Thus, also in the process of the invention there is made use of the respective coarse and fine stone fractions, but now with addition of the crucial circumstance that the two fractions are treated with respective, very different emulsions.

The principle of the invention may be advantageously used also for the production of an asphalt material in which the binding agent is bitumen in non-emulsified condition. Here the coarse stone fraction is heated to such a high temperature, by which the stones can be totally coated by the initially added high viscid bitumen, which, itself, is heated to assume a viscosity suitably low for this purpose. Thereafter the fine fraction is added to the mixer, in either cold or warm condition all according to the applied low viscid bitumen, which is also added; this bitumen should have a temperature high enough to condition such a low viscosity that the bitumen can effectively coat the stone particles of the fine fraction. Preferably, this temperature should be somewhat lower than the temperature of the coarse fraction, such that the coating of the coarse stones by the high viscid bitumen will be stabilized.

Generally, with the considered method it is possible to work with a very high viscid bitumen for the initial mixing with the coarse stone fraction, just when care is taken that the fine fraction is not added until an extensive coating of the coarse stones has been obtained. As far as the emulsion concrete is concerned it is important that the relevant 'hard' emulsion is widely broken before the fine fraction and the associated 'soft' emulsion is added, but it is a lucky coincidence that the very addition of the fine stone fraction, with its very large surface area, strongly promotes the breaking of the hard emulsion, such that the latter will break finally almost automatically at an ideal moment of the process. With the hot method it is sufficient to use a moderate heating, as the high viscid bitumen shall not be conditioned to be mixed with the fine stone fraction. All according to the application purpose this bitumen may have a viscosity e.g. in the range of 5000–75000 $mm^2$/sec at 60° C.

With the use of the 'soft' emulsion or the low viscid bitumen, respectively, in connection with the fine stone fraction it is possible to achieve a homogenous admixture into the fine fraction, also here without any extensive heating as far as the hot method is concerned. The viscosity of the relevant bitumen should normally be somewhat lower that 3000 $mm^2$/sec, but under special circumstances this figure may be higher, e.g. up to 4–5000, though still noticeably smaller than the viscosity figure of the applied high viscid bitumen.

The weight ratio between the two kinds of bitumen may vary all according to the dispensary of the material mixture, but a typical ratio can be 60% PC % high viscid and 40% PC % low viscid bitumen. Already some 24 hours after the laying out of the material an equalization of the viscosities will have taken place, and on this background it is perfectly possible, if desired, to obtain resulting viscosity figures of MB 10–30,000 or more, this being unheard in connection with conventional emulsion concrete and very expensively achievable in other conventional asphalt preparation.

The applied mixing plant can be a simple batch mixer or a continuous throughflow mixer, but it would be possible to use separate mixers for the mixing of the respective binding agents into the respective stone fractions and a separate mixer for the bringing together of the thus pretreated fractions.

When preparing the emulsion concrete it will be advantageous to control the breaking of the 'hard' emulsion such that it will break as soon as a practically total wrapping of the coarse stones has taken place, e.g. after a mixing time of 10–12 seconds, such that this emulsion will not get time to be 'diluted' with the subsequently added 'softer' emulsion as added in connection with the addition of the fine stone fraction. Thereby the hard emulsion can be dosed in accordance with the desired maximum carrying capacity of the stones of the coarse fraction, while a dilution of the emulsion would cause a weakening of this carrying capacity and thereby of the possibility of an efficient exploitation of the high viscid bitumen.

Another important effect of the rapid addition of the fine stone fraction as soon as the hard emulsion has been distributed and broken is that by this addition an advanced adhesion between the stones of the coarse fraction will be prevented, which could otherwise give rise to undesired lump formations. In practice it is correspondingly important that the breaking of the added 'soft' emulsion takes place no later than by the finishing and delivering of the material mixture from the mixing plant, in order to counteract later problems with respect to washing out of the emulsion after the laying out of the material or already during the transportation thereof to the working place. It is less important whether the soft emulsion is added briefly before, concurrently with, or briefly after the addition of the fine stone fraction.

It is essential to notice that the very controlling of the breaking time of the applied emulsions belongs to already well established art, such that this will not have to be further elucidated in the present connection.

In connection with the invention it will be possible to pretreat the coarse stone fraction with the emulsion containing the high viscid bitumen, while by the addition of the fine stone fraction there is not used any emulsion, but a bitumenous binding agent having a quite low viscosity, e.g. MB 1500–2000 at 60° C. This additive may be administered in cold condition, and it will render the material well shapeable. In so far as the migration with the high viscid bitumen will take place soon after the laying out, a desirable result will be achievable also in this manner, even when the resulting bitumen percentage of the material may be still higher by the use of the 'soft' emulsion for the fine stone fraction.

Hereafter a few examples of dispensaries according to the invention should be given:

EXAMPLE 1

Stone material: 60 weight percent of 4–16 mm coarse fraction;

40% PC % weight percent of 0–4 mm fine fraction.

Binding agent emulsion: Type 1: BE65R/20,000

Type 2: BE65M/3,000.

In these denominations, "BE" stands for "bitumen emulsion", "65" for the admixtury percentage of the bitumen, "R" for a rapidly breaking emulsion, "M" for a medium breaking emulsion, and the figure indications 20,000 and 3,000 for the viscosity of the respective bitumens, measured by $mm^2$/sec at 60° C.

By experiments it is established that the breaking time for the emulsion type 1 on the coarse fraction type of stones is a certain amount of seconds, e.g. 12–14 seconds. The course fraction is introduced currently and without heating into a flow-through mixer, at the entrance end of which the emulsion of the said type 1 is added by a flow corresponding to a weight amount of 7–8% PC % of the stone weight. In the mixer, the aqueous solution of the emulsion will be distributed evenly around the stones in few seconds. At a downstream place of the mixer, corresponding to a material transportation times of 14–16 seconds, a flow of the fine stone fraction and emulsion type 2 at a weight ratio of some 100:8 is added. The total product is conveyed further in the mixer for intensive mixing through additional 20–30 seconds, corresponding approximately to the breaking time of the emulsion type 2, whereafter the mixture is let out in a flow to a carrier truck. The truck takes the collected material portion to a delivery apparatus at the working site, where the laying out is effected not later than 4–5 hours after the preparation of the material mixture. In the laid out emulsion concrete there will be a residual bitumen percentage of approximately 5.

EXAMPLE 2

Stone material: 60 weight percent of 5–18 mm coarse fraction 40 weight percent of 0–5 mm fine fraction.

Binding agent: Type 1: B 180

Type 2: MB 3,000

In these denominations "B" stands for a pure or non-emulsified bitumen, while the figure 180 refers to a penetration of 180 at 25° C., corresponding to a viscosity of some 60,000 $mm^2$/sec at 60° C. MB 3,000 denotes the non-emulsified betumen having a viscosity of 3,000 $mm^2$/sec at 60° C.

1800 kg stones of the coarse fraction heated to some 130° C. is filled into a charge mixer, and after start of the mixer 90 kg binding agent type 1, heated to some 130° C. is added. 8–12 seconds thereafter 1200 kg of the fine fraction is added, this fraction not having to be heated, and also 60 kg binding agent type 2, heated to roughly 90° C. When the mixture portion of about 3 tons has been homogenously mixed, e.g. after 25 seconds, the charge is let out to a carrier truck, and care is taken that the mixture is laid out not more than 5–6 hours after its preparation. The delivery temperature in the mixer can be some 60° C.

I claim:

1. A method of preparing an emulsion or asphalt concrete to be laid out as a road material, comprising:

mixing a coarse stone fraction with a high viscid bitumen binder to form a first mixture, said high viscid bitumen binder being selected from the group consisting of a first bitumen emulsion prepared for rapid breaking and a heated non-emulsified bitumen of high viscosity;

adding to said first mixture and mixing therein a fine stone fraction, said fine stone fraction being finer than said coarse stone fraction, and a low viscid bitumen binder to form a second mixture, said low viscid bitumen binder having a viscosity lower than that of said high viscid bitumen binder and being selected from the group consisting of a second bitumen emulsion prepared to break no later than laying out of the material and a non-emulsified bitumen of low viscosity; and collecting said second mixture prior to total bonding.

2. A method according to claim 1 wherein said high viscid bitumen binder has a viscosity of 5,000 to 75,000 $mm^2$/sec at 60° C.

3. A method according to claim 2, wherein said low viscid bitumen binder has a viscosity lower than 5,000 $mm^2$/sec.

4. A method according to claim 2, wherein said low viscid bitumen binder has a viscosity less than 3,000 $mm^2$/sec.

5. A method according to claim 1, wherein said low viscid bitumen binder has a viscosity lower than 5,000 $mm^2$/sec.

6. A method according to claim 1, wherein said low viscid bitumen binder has a viscosity less than 3,000 $mm^2$/sec.

7. A method according to claim 1, wherein said high viscid bitumen binder is said first bitumen emulsion prepared for rapid breaking and wherein said first bitumen emulsion is broken as soon as total wrapping of said coarse stone fraction has taken place.

8. A method according to claim 1, wherein said high viscid bitumen binder is said first bitumen emulsion and wherein the addition of said fine stone fraction to said first mixture breaks said first bitumen emulsion.

9. A method according to claim 1, wherein said high viscid bitumen binder is said heated non-emulsified bitumen of high viscosity, wherein said low viscid bitumen binder is said non-emulsified bitumen of low viscosity, and wherein said non-emulsified bitumen of low viscosity is added to said first mixture after being heated to a temperature high enough to effectively coat particles of said fine stone fraction but lower than a temperature to which the non-emulsified bitumen of high viscosity is heated.

10. A method according to claim 1, wherein said low viscid bitumen binder is said second bitumen emulsion, and wherein said second bitumen emulsion is prepared to break no later than finishing and delivering of said second mixture from a mixing plant.

* * * * *